US006949718B1

(12) United States Patent
Hockenberry et al.

(10) Patent No.: US 6,949,718 B1
(45) Date of Patent: Sep. 27, 2005

(54) FROST REMOVAL DEVICE FOR THAWING FROZEN GROUND IN WORK AREAS

(76) Inventors: Richard H. Hockenberry, 1730 Hosner Rd., Oxford, MI (US) 48371; Lisa Hockenberry, 1730 Hosner Rd., Oxford, MI (US) 48371

( * ) Notice: Subject to any disclaimer, the term of this patent is extended or adjusted under 35 U.S.C. 154(b) by 22 days.

(21) Appl. No.: 10/651,719

(22) Filed: Aug. 29, 2003

(51) Int. Cl.[7] ..... H05B 3/04
(52) U.S. Cl. ..... 219/386; 219/521; 219/220
(58) Field of Search ..... 219/213, 220, 219/385, 386, 411, 521; 392/407, 411; 439/271, 439/280

(56) References Cited

U.S. PATENT DOCUMENTS

| | | | | |
|---|---|---|---|---|
| 1,224,030 | A * | 4/1917 | Smith | 439/280 |
| 1,345,593 | A * | 7/1920 | Giddens | 219/521 |
| 2,263,061 | A * | 11/1941 | Allen | 362/549 |
| 2,430,490 | A * | 11/1947 | Bray | 392/411 |
| 2,434,166 | A * | 1/1948 | Klumpp | 219/220 |
| 2,511,643 | A * | 6/1950 | Lawrence | 219/521 |
| 2,648,152 | A * | 8/1953 | Simpson | 40/576 |
| 2,694,135 | A * | 11/1954 | Brockmole | 392/411 |
| 2,767,297 | A * | 10/1956 | Benson | 219/411 |
| 3,062,941 | A * | 11/1962 | White | 219/478 |
| 3,249,737 | A * | 5/1966 | Casebeer | 219/220 |
| 4,349,724 | A * | 9/1982 | Ellersick | 392/411 |
| 5,216,948 | A * | 6/1993 | Sheppard et al. | 219/385 |
| 5,614,119 | A * | 3/1997 | Ollis | 219/385 |
| 6,194,686 | B1 * | 2/2001 | Gohl | 219/213 |

FOREIGN PATENT DOCUMENTS

| | | | |
|---|---|---|---|
| JP | 2002-69961 | * | 3/2002 |

* cited by examiner

*Primary Examiner*—Teresa J. Walberg

(57) ABSTRACT

A device used to thaw a volume of frozen ground where there is a need to dig a posthole, concrete footing, grave, or other cavity, essentially comprises an inverted housing having a closed top and open bottom and one or more light bulbs for providing heat, which are attached through holes in the top surface. The housing further comprises an outer wall with insulation attached to the inside surfaces. The open end of the device has a flange for securing the device to the ground and sealing in most of the produced heat. Light bulb sockets are mounted through rubber grommets, which provide water proofing, within holes in the top surface with 110-volt light bulbs being screwed in from the inside of the device. The device can be formed in many shapes, including rectangular, circular, 90-degree corner, 45-degree corner, and curved corner. Also, multiple devices can be fastened together for use over large area plots of ground.

18 Claims, 5 Drawing Sheets

FROST REMOVAL DEVICE FOR THAWING FROZEN GROUND IN WORK AREAS

BACKGROUND OF THE INVENTION

1. Field of the Invention

The present invention relates to a frost removal device for use in connection with thawing the ground in work areas. The frost removal device has particular utility in connection with thawing the ground in the area where a posthole or ground cavity is to be dug.

2. Description of the Prior Art

In northern climates where the ground can remain frozen for months in the wintertime, it can be very difficult to dig postholes, trenches, concrete footings, construction pile holes, graves, and other cavities in the ground. It would be desirable to have a new, inexpensive, and easy to use device for thawing the ground in the area where work is to be performed.

The use of frost removing devices is known in the prior art. For example, U.S. Pat. No. 6,194,686 to Gohl discloses a portable ground thawing panel system that uses an electrical heating element, other than a light bulb, to thaw a spot on the ground where the panel is set. However, the Gohl '686 patent discloses a device that is different in structure from the present invention and does not use an insulated custom shaped housing with one or more internally mounted light bulbs for generating the heat to thaw the ground.

U.S. Pat. No. 4,349,010 to Bentham discloses a frost removal system that places a device over the work area, covers it with sand for insulation, and passes heated gasses through piping in the device for thawing the area. However, the Bentham '010 patent discloses a device that is different in structure from the present invention and does not use an insulated custom shaped housing with one or more internally mounted light bulbs for generating the heat to thaw the ground.

Similarly, U.S. Pat. No. 3,249,737 to Casebeer discloses a portable heater for heating an automobile engine crankcase. The heater has an insulated telescoping housing with built in heating element. However, the Casebeer '737 patent discloses a device that is different in structure and utility from the present invention.

Also, U.S. Pat. No. 5,128,518 to Reifel discloses an electrically heated horse bit warmer that has a housing an light bulb heater. However, the Reifel '518 patent discloses a device that is different in structure from the present invention and does not use insulated housing walls since the horse bit application requires much less heat than does the application of the present invention.

Lastly, U.S. Pat. No. 4,646,818 to Ervin and U.S. Pat. No. 3,868,825 to Boyce discloses apparatus that may be of general interest and pertinent to the construction and design of the present invention. The Ervin '818 patent discloses heated mats for melting snow and ice from outdoor surfaces that passes hot mixtures through pipes built into the mats. Finally, the Boyce '825 patent discloses apparatus for thawing frozen ground that circulates hot air through the device. However, these patents disclose apparatus that is different from that of the present invention and neither discloses an insulated custom shaped housing with one or more internally mounted light bulbs for generating the heat to thaw the ground.

While the above-described devices fulfill their respective, particular objectives and requirements, the aforementioned patents do not describe a frost removal device that has the structure of the present device where light bulbs, strategically placed in an insulated custom shaped housing, are used to thaw the ground over which the device is positioned.

Therefore, a need exists for a new and improved frost removal device that can be easily and quickly installed for thawing the ground in a relative short period of time. In this regard, the present invention substantially fulfills this need. In this respect, the frost removal device according to the present invention substantially departs from the conventional concepts and designs of the prior art, and in doing so provides an apparatus that will be inexpensive, easy to use, and efficient.

SUMMARY OF THE INVENTION

In view of the foregoing disadvantages inherent in the known types of frost removing equipment now present in the prior art, the present invention provides an improved frost removal device, and overcomes the above-mentioned disadvantages and drawbacks of the prior art. As such, the general purpose of the present invention, which will be described subsequently in greater detail, is to provide a new and improved frost removal device and method that has all the advantages of the prior art mentioned heretofore and other novel features that result in a frost removal device that is not anticipated, rendered obvious, suggested, or even implied by the prior art, either alone or in any combination thereof.

The device of the present invention can be used to thaw a volume of frozen ground where there is a need to dig a posthole, concrete footing, grave, or other cavity.

To attain this, the present invention essentially comprises an inverted housing, which can be practically any shape, having a closed top and open bottom, and one or more light bulbs for providing heat, attached through a hole in the top surface. The housing further comprises an outer wall and an inner wall with insulation sandwiched between the two walls. Optionally, the inner wall can be eliminated leaving the insulation exposed and thereby reducing the cost of the device. The open end of the device has a flange for securing the device to the ground and sealing in most of the produced heat. Typically, 110-volt light bulb sockets are mounted through rubber grommets, which provide water proofing, within holes in the top surface with light bulbs being screwed in from the inside of the device. One or more light bulbs of 100-watts or greater are generally used in the device, although lower wattage bulbs could be used.

The device can be formed in any desired shape, including but not limited to circular, 90-degree corner, 15-degree corner, curved corner, and rectangular. The outer wall is made opaque to prevent light from being visible from outside the device. Also, multiple devices can be fastened together for use over large area plots of ground.

In use, the device is placed on the frozen ground over the spot to be dug making sure that the flange is in contract with ground. The light bulb(s) are then plugged into a 110-volt power source and the device is left for several hours, depending on the temperature and depth of the hole, to pull frost out of the ground. Once the ground has been adequately thawed and workmen are ready to begin the digging process, the power is turned off and the device is removed from over the site.

There has thus been outlined, rather broadly, the more important features of the invention in order that the detailed description thereof that follows may be better understood and in order that the present contribution to the art may be better appreciated.

There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved frost removal device that provides in the apparatuses and methods of the prior art some of the advantages thereof, while simultaneously overcoming some of the disadvantages normally associated therewith.

It is another object of the present invention to provide a new and improved frost removal device that may be easily and efficiently manufactured and marketed.

An even further object of the present invention is to provide a new and improved frost removal device that has a low cost of manufacture with regard to both materials and labor, and which accordingly is then susceptible of low prices of sale to the consuming public, thereby making such equipment economically available to the buying public.

Lastly, it is an object of the present invention to provide a new and improved method for thawing the frozen ground in a work area where digging is required.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description males reference to the annexed drawings wherein.

The same reference numerals refer to the same parts throughout the various figures.

DESCRIPTION OF THE PREFERRED EMBODIMENT

Figure 1:
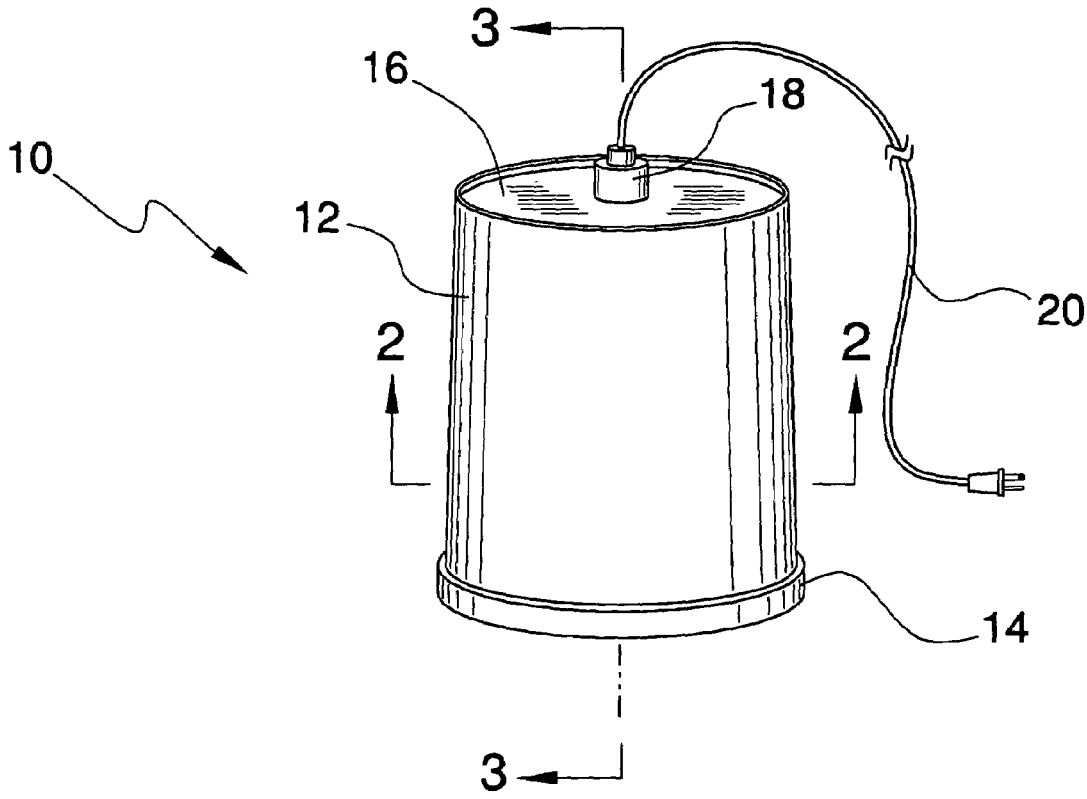
FIG. 1 is a perspective view of the preferred embodiment of the frost removal device constructed in accordance with the principles of the present invention.

Referring now to the drawings, and particularly to FIGS. 1–5, a preferred embodiment of the frost removal device (puller) of the present invention is shown and generally designated by the reference numeral 10.

In FIG. 1, a new and improved frost removal device 10 of the present invention for thawing the frozen ground in a work area where digging is required is illustrated and will be described. More particularly, the frost removal device 10 has an inverted housing, which has a closed top 16 and open bottom, and one or more light sockets 18 extending downward through a hole in the top surface. The housing further comprises an outer wall 12 and an inner wall with insulation sandwiched between the two walls. Furthermore, the open end of the device has a flange 14, which fits closely to the ground, for securing the device to the ground and sealing in most of the produced heat. 110-volt power is supplied to the device through a power cord 20.

Figure 2:
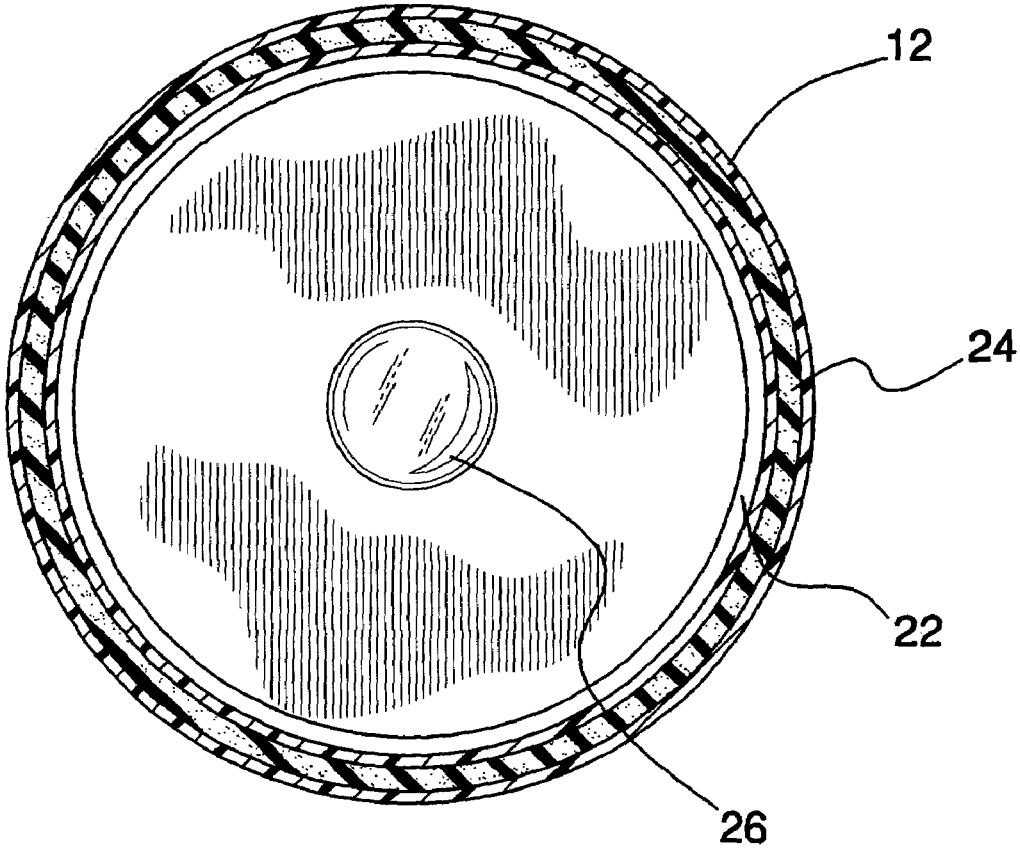
FIG. 2 is a cross-sectional top view of the frost removal device of the present invention.
Figure 3:
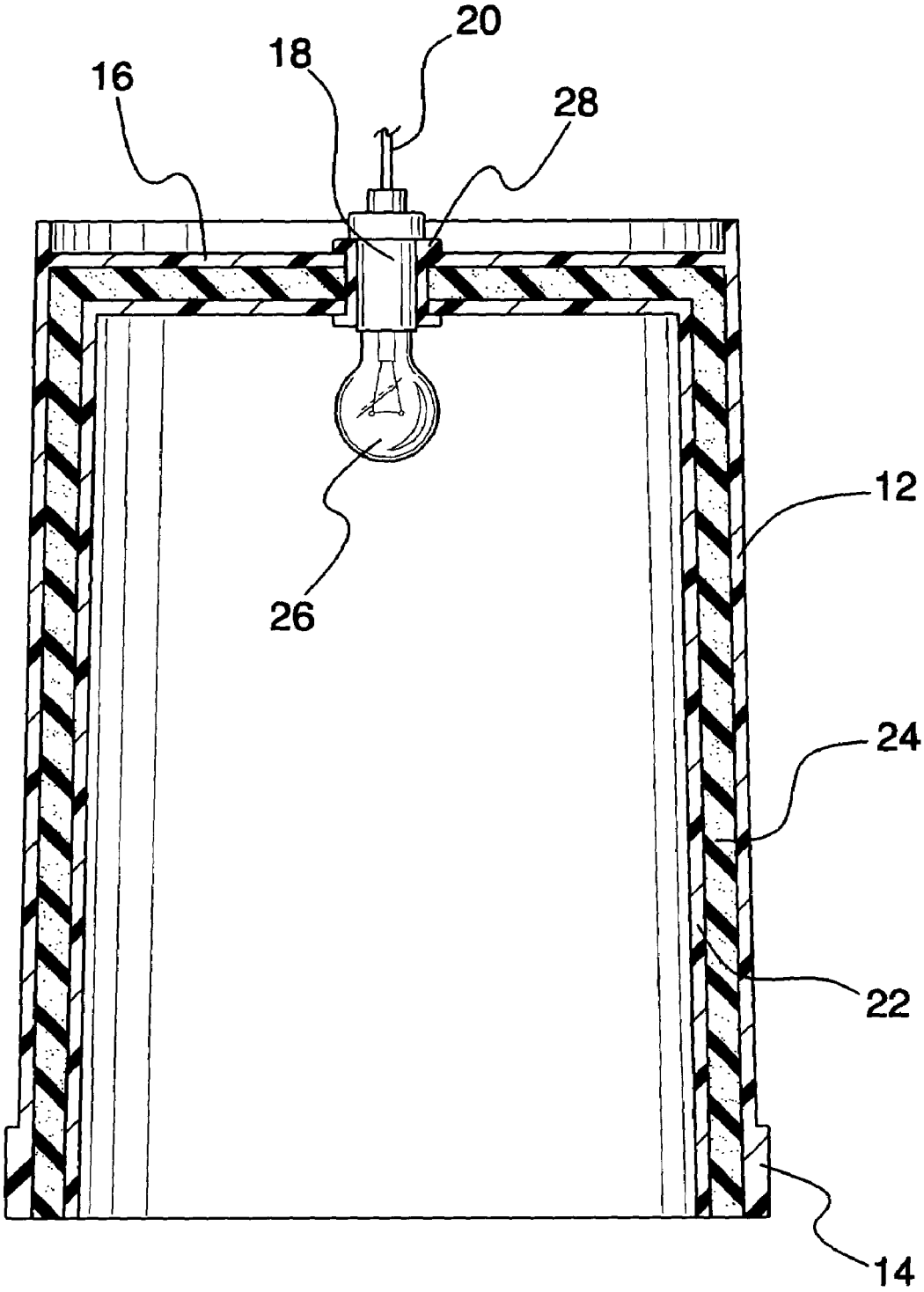
FIG. 3 is a cross-sectional side view of the frost removal device of the present invention.

FIGS. 2 and 3 are cross-sectional top and side views, respectively, of the frost removal device of the present invention. These views more clearly show the insulation 24 sandwiched between the inner wall 22 and outer wall 12 on both the sides and top of the device. The light socket 18 is inserted through the hole in the top of the device and sealed by rubber grommet means 28 to prevent water from getting into the socket and into the housing in general. A light bulb 26 of adequate wattage is screwed into the socket 18. The bottom flange 14 is molded around the bottom of the device. Although, this preferred embodiment discloses a cylindrical housing, practically any custom shape needed to fit over a concrete footing or other work area can be used, such as rectangular, 90-degree corner, 45-degree corner, curved corner. The housing can typically be fabricated out of metal, plastic, wood, fiberglass, or polystyrene. The outer surface is made opaque to prevent light from being visible from outside the device.

Figure 4:
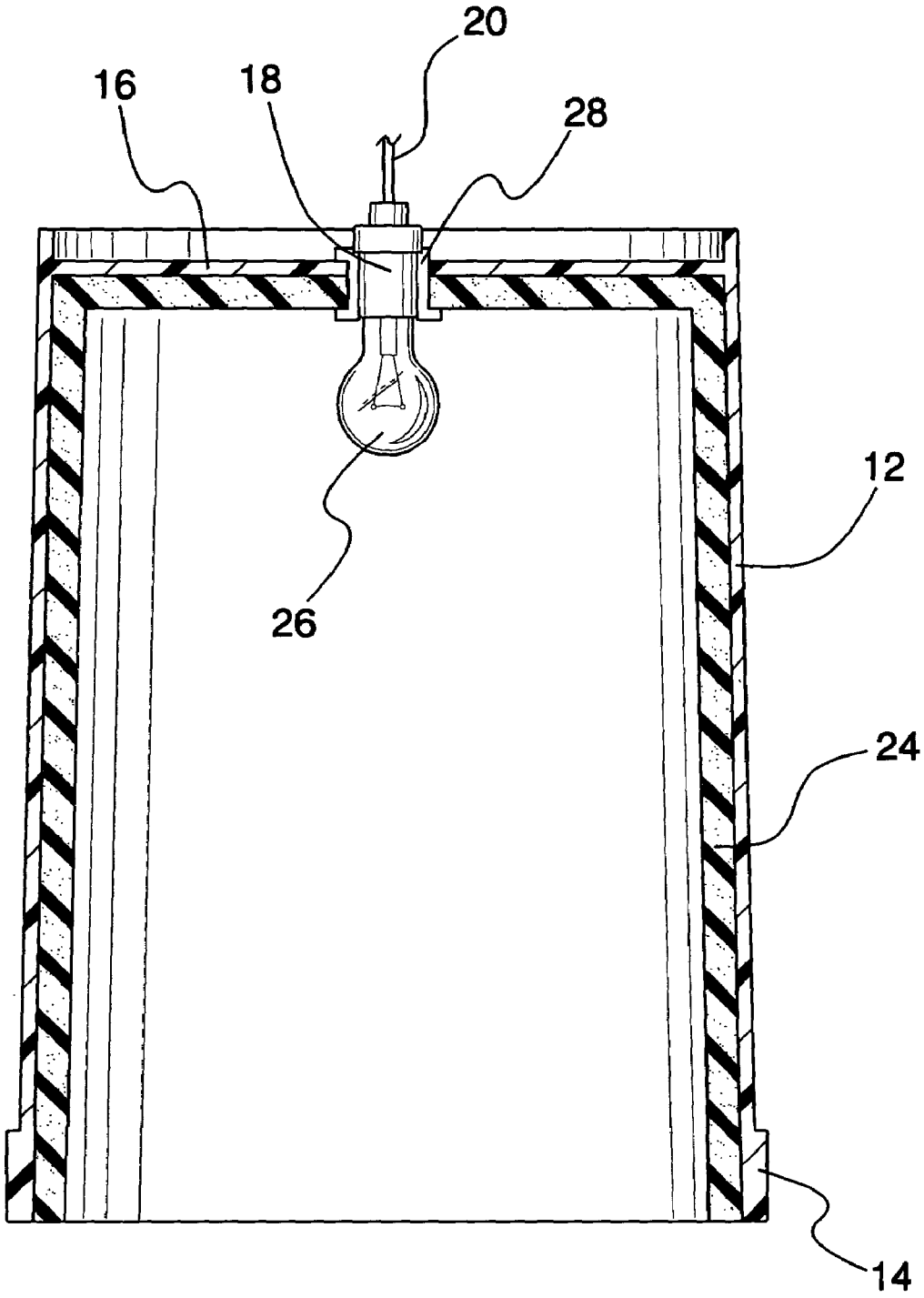
FIG. 4 is a cross-sectional side view of a second embodiment of the frost removal device of the present invention, which eliminates the inner wall and therefore reduces the cost of the device.

FIG. 4 is a cross-sectional side view of a second embodiment of the frost removal device of the present invention, which eliminates the inner wall 22 and thereby reduces the cost of the device. This configuration leaves insulation exposed on the inside of the housing.

Figure 5:
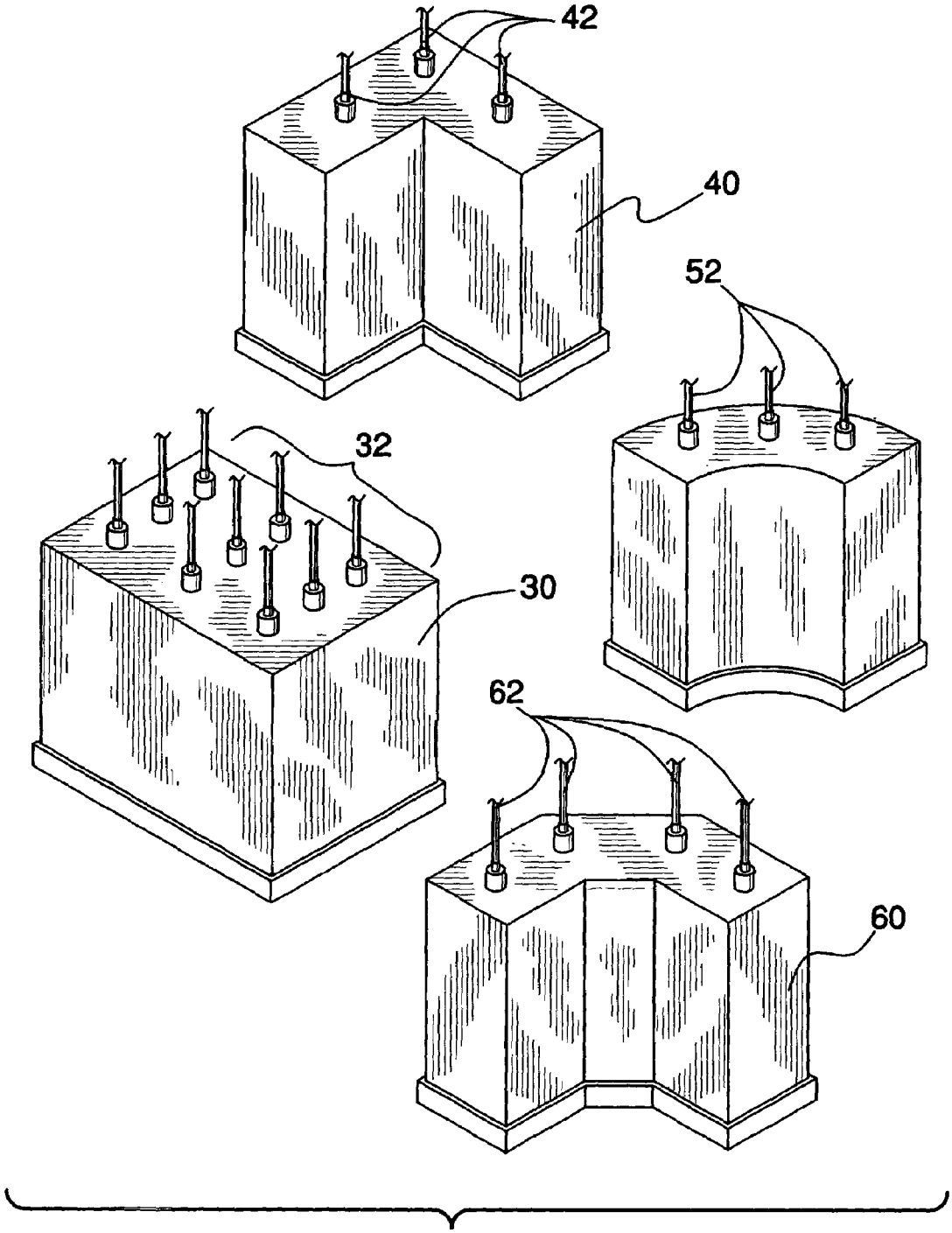
FIG. 5 shows perspective views of various configurations of the frost removal device of the present invention.

Finally, FIG. 5 shows perspective view examples of various other configurations of the frost removal device of the present invention, including a rectangular gravesite frost removal device 30, a 90-degree corner device 40, a curved device 50, and 45-degree corner device 60. The rectangular gravesite device 50 will be approximately 40-inchess wide by 108-inches long (with an aspect ratio of 2.7:1) an will have a plurality (12 shown) of light sockets 32 and light bulbs. It can be scaled down for use with smaller graves while maintaining the 2.7:1 aspect ratio. The 90-degree corner device 40, curved device 50, and 45-degree corner device 60 will also have a plurality of light sockets 42,52,62 and light bulbs, respectively, as needed. The size of these devices will depend on the footprint of the work area. Again, where needed multiple device can be connected to cover a desired footprint.

In use, it can now be understood that the device 10 is placed on the frozen ground over the footprint spot to be dug making sure that the flange 14 is in contract with ground. Also, the devices can be fastened together for use over large area plots of ground. The power cord 20 is then plugged into a 110-volt power source and the device is left for several hours, depending on the temperature and depth of the hole, to pull frost out of the ground. Once the ground has been adequately thawed and workmen are ready to begin the digging process, the power is turned off and the device is removed from over the site.

While a preferred embodiment of the frost removal device has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material can be used to fabricate the devices. Also, various size and wattage light bulbs can be used with the device.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A frost removal device, comprising:

an inverted outer housing, said outer housing having a closed top and open bottom, said outer housing further having one or more holes in said closed top for mounting light bulbs;

a heat insulating layer attached to the inside surfaces of said outer housing;

a ground flange attached around the perimeter of said open bottom of said device;

a rubber grommet mounted in each of said holes in said closed top of said device;

a light socket mounted through said rubber grommet in each of said holes in said closed top of said device, said light sockets being water proof by means of said rubber grommets;

a light bulb screwed into each said light socket for heating the frozen ground; and a power cord having opposing ends with one end directly connected to said light socket and said opposing end connected to a source of electricity.

2. The device of claim 1, said outer housing being fabricated from material from the group consisting of metal, plastic, wood, fiberglass, and polystyrene.

3. The device of claim 1, wherein any standard size and wattage light bulb can be used to provide the heat needed in a particular application.

4. The device of claim 1, said outer housing being further molded in the shape from the group consisting of cylindrical, rectangular, 90-degree corner, 45-degree corner, and curved corner.

5. The device of claim 1, wherein said device is rectangular with an aspect ratio of approximately 2.7:1 for use in thawing the ground at a grave site, said device further being fined with a plurality of light bulbs.

6. The device of claim 1, wherein said outer housing of said device is made opaque to prevent light from being visible from outside said device.

7. The device of claim 1, said devices being used to thaw the ground for applications from the group consisting of postholes, concrete footings, trenches, construction piles, ditches, tree cavities, and graves.

8. The device of claim 1, wherein an inner cylindrical housing is mounted concentrically inside said outer housing, said inner housing having a closed top and open bottom, said inner housing further having one or more holes in said closed top for mounting light bulbs.

9. A method for thawing the frozen ground in work areas for digging postholes, concrete footings, trenches, construction piles, ditches, tree cavities, and graves, comprising the steps of:

providing a frost removal device, said device further comprising:

an inverted outer housing, said outer housing having a closed top and open bottom, said outer housing further having one or more holes in said closed top for mounting light bulbs;

a heat insulating layer attached to the inside surfaces of said outer housing;

a ground flange attached around the perimeter of said open bottom of said device;

a rubber grommet mounted in each of said holes in said closed top of said device;

a light socket mounted through said rubber grommet in each of said holes in said closed top of said device, said light sockets being water proof by means of said rubber grommets, wherein each of said light sockets is individually and directly connected to one end of a power cord having its opposing end connected to a source of electricity; and a light bulb screwed into each said light socket for heating the frozen ground;

placing said device over the frozen ground worksite with one or more devices being connected together where needed;

making sure that said ground flange is properly sealed against the ground, applying 110-volt power to said device;

leaving said device in place for an adequate time depending on the temperature and application conditions; and removing said device from work site, thereby leaving said ground thawed and ready to work.

10. The method of claim 9, said outer housing being fabricated from material from the group consisting of metal, plastic, wood, fiberglass, and polystyrene.

11. The method of claim 9, wherein any standard size and wattage light bulb can be used to provide the heat needed in a particular application.

12. The method of claim 9, said outer housing being further molded in the shape from the group consisting of cylindrical, rectangular, 90-degree corner, 45-degree corner, and curved corner.

13. The method of claim 9, wherein said device is rectangular with an aspect ratio of approximately 2.7:1 for use in thawing the ground at a grave site, said device further being fined with a plurality of light bulbs.

14. The method of claim 9, wherein said outer housing of said device is made opaque to prevent light from being visible from outside said device.

15. The method of claim 9, wherein an inner cylindrical housing is mounted concentrically inside said outer housing, said inner housing having a closed top and open bottom, said inner housing further having one or more holes in said closed top for mounting light bulbs.

16. A frost removal device for thawing ground work areas involving digging postholes, concrete footings, trenches, construction piles, ditches, tree cavities, and graves, comprising:

an inverted outer housing, said outer housing having a closed top and open bottom, said outer housing further having one or more holes in said closed top for mounting light bulbs, said outer housing being opaque to prevent light from being visible outside said device, said housing being molded in the shape from the group comprised of: rectangular, cylindrical, 90-degree corner, 45-degree corner, and curved corner, said housing further being fabricated from material from the group comprised of: metal, plastic, wood, fiberglass, and polystyrene;

a heat insulating layer attached to the inside surfaces of said outer housing;

a ground flange attached around the perimeter of said open bottom of said device;

a rubber grommet mounted in each of said holes in said closed top of said device;

a light socket mounted through said rubber grommet in each of said holes in said closed top of said device, said light sockets being water proof by means of said rubber grommets, wherein each of said light sockets is individually and directly connected to one end of a power cord having its opposing end connected to a source of electricity; and a light bulb screwed into each said light socket for heating the frozen ground, any standard size and wattage light bulb being used to provide the heat needed for a particular application.

17. The device of claim 16, wherein said device is rectangular with an aspect ratio of approximately 2.7:1 for use in thawing the ground at a grave site, said device further being fitted with a plurality of light bulbs.

18. The device of claim 16, wherein an inner cylindrical housing is mounted concentrically inside said outer housing, said inner housing having a closed top and open bottom, said inner housing further having one or more holes in said closed top for mounting light bulbs.

* * * * *